US005386790A

United States Patent [19]

Nakamura

[11] Patent Number: 5,386,790

[45] Date of Patent: Feb. 7, 1995

[54] WAISTBELT END GRIPPING APPARATUS

[75] Inventor: Satoshi Nakamura, Chofu, Japan

[73] Assignee: Juki Corporation, Tokyo, Japan

[21] Appl. No.: 64,765

[22] Filed: May 19, 1993

[30] Foreign Application Priority Data

May 20, 1992 [JP] Japan ..... 4-152627

[51] Int. Cl.[6] ..... D05B 35/08

[52] U.S. Cl. ..... 112/121.27

[58] Field of Search ..... 112/121.27, 121.12, 112/121.26, 152, 2, 136, 147, 144

[56] References Cited

U.S. PATENT DOCUMENTS 4,079,682 3/1978 Nishiwaki ..... 112/144 X 4,425,858 1/1984 Hargett ..... 112/121.12

4,577,571 3/1986 Carson ..... 112/121.27

4,606,287 8/1986 Papajewski et al. ..... 112/121.27

4,699,302 10/1987 Papajewski et al. ..... 112/121.27

5,127,349 7/1992 Nakamura ..... 112/121.27

*Primary Examiner*—Clifford D. Crowder

*Assistant Examiner*—Paul C. Lewis

*Attorney, Agent, or Firm*—Morgan & Finnegan

[57] ABSTRACT

A waistbelt end pinching apparatus which includes a selvage pinching base movable between a starting position, a set position and a waiting position, a pair of selvage pincher jaws supported to pivot them away from and close to each other, the upper jaw being adapted to position the waistbelt end terminal slightly rearwardly away from the lower jaw.

7 Claims, 8 Drawing Sheets

FIG.9
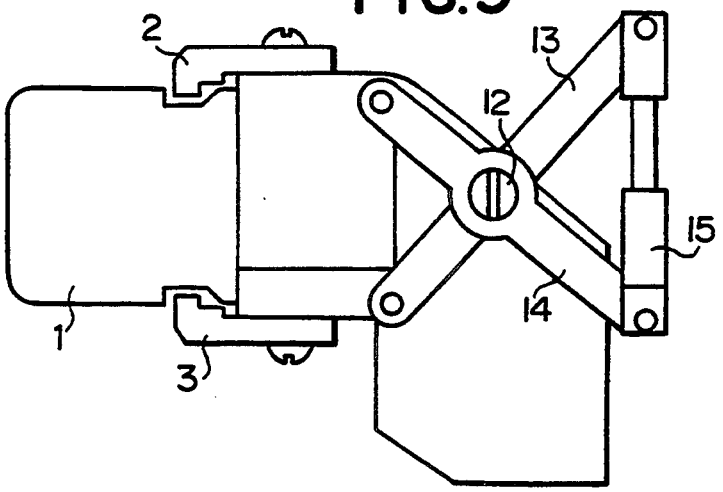
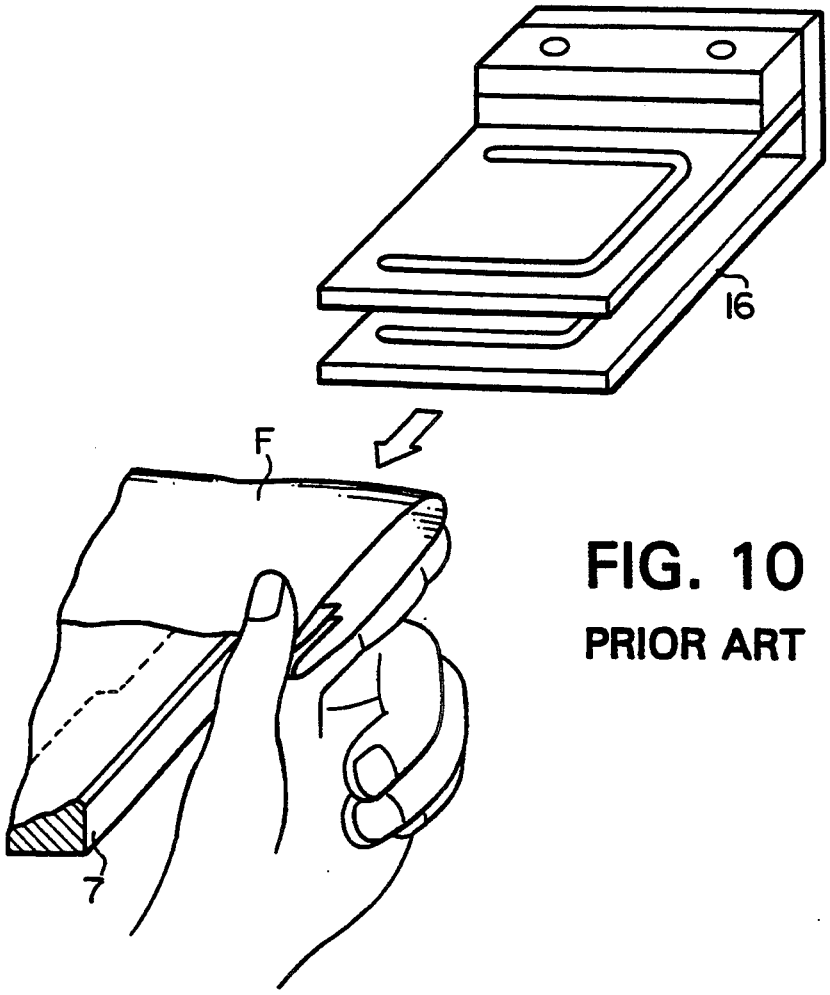
FIG. 10
PRIOR ART

WAISTBELT END GRIPPING APPARATUS

BACKGROUND OF THE INVENTION

1. Field of the Invention

This invention relates to an improvement in a sewing machine, and more particularly, to a sewing machine for use in an apparatus for pinching, positioning, and retaining a waistbelt end or waistband end before the waistbelt end is set to a garment setting plate. The present invention further relates to a waistbelt end pinching mechanism for an automatic waistbelt end folding machine adapted to fold the waistbelt inside double, which waistbelt is to be sewn to an upper portion of garments such as jeans, work pants, denim jackets, slacks and the like.

2. Description of the Prior Art

A waistband end pinching apparatus of this class has been disclosed by the same inventor for the subject application in U.S. Pat. No. 5,127,349, entitled "Sewing Machine". This sewing machine is composed of, as shown in the accompanying drawings FIGS. 13–15, a sewing head 100 for sewing the waistbelt 104*a* of the trousers 104 after the end portion of the waistbelt has been tucked into the waistbelt, setting means 101 insertable into the waistbelt of the trousers to position the waistbelt of the trousers prior to tucking of the end portion 104*b* of the waistbelt into the waistbelt 104*a*, tuck-in means 102 insertable into the waistbelt while the waistbelt is engaged by said setting means to tuck an end portion of the waistbelt, holder means 103 engageable with upper and lower side surfaces of the waistbelt to grip the waistbelt.

It has been heretofore customary to pinch a waistband end F of fabric or the like with the fingers of the operator for positioning and holding the waistbelt end until a cassette holder 16 of the holder means is advanced to hold the waistbelt end in position, as shown in FIG. 10, after it has been set to the garment setting plate of the setting means. The waistbelt is generally shaped into two piles of fabric contiguous to each other, the upper fold of the double-folded waistbelt being dimensioned shorter than the lower fold by about 1 mm. The former fold is sewed to the fly front of the body for the purpose of not only improving the quality of the lower fold but also avoiding poor needle penetration and skipped stitches.

Such fine adjustment or setting of the waistbelt end through finger work will result in less workability and more variation in retention of the waistbelt end, leading the waistbelt to variation in quality after the waistbelt has been sewed and possible injury to the fingers which hold the waistbelt end F when the cassette holder 16 is advanced.

SUMMARY OF THE INVENTION

It is therefore an object of the present invention to provide an improved waistbelt end pinching apparatus which improves workability of the positioning end pinching apparatus which thereby improves the workability of positioning and holding the waistbelt end in a stable and safe manner and without any difficulty and without possible injury to the fingers of the operator.

Another object of the invention is to provide a waistbelt end pinching apparatus which is capable of preserving the best quality of the waistbelt as folded.

A further object of the invention is to provide a waistbelt end pinching apparatus which is capable of readily setting the waistbelt end to the fly front of the garment after positioning and holding the waistbelt end.

To achieve the aforementioned objects, the waistbelt end pinching apparatus according to the present invention is provided with a selvage pinching base which is movable between a starting position, a set position and a waiting position, a pair of selvage gripper jaws which are supported to pivot them away from and close to each other, the upper jaw being adapted to position the waistbelt end terminal slightly rearwardly away from the lower jaw.

In accordance with the aspect of the invention, the waistbelt end pinching apparatus is covered with the waistbelt end each of whose fold terminals is urged between the gripper jaws and the pinching base. The gripper jaws are then brought together. Then, the pinching base is moved back to the set position to set the fabric to the garment setting to be in a light stretched condition. A cassette holder is advance to clamp the waistbelt end to open the gripper jaws, moving the gripper base back to the waiting position.

Furthermore, the sewing machine for use to this end includes a sewing head 100 for sewing the waistbelt 104*a* of the trousers 104 after the end portion of the waist belt has been tucked into the waistbelt, setting means 101 insertable into the waistbelt of the trousers to position the waistbelt of the trousers prior to tucking of the end portion 104*b* of the waistbelt into the waistbelt 104*a*, tuck-in means 102 insertable into the waistbelt while the waistbelt is engaged by said setting means to tuck an end portion of the waistbelt, holder means 103 engageable with upper and lower outside surfaces of the waistbelt to grip the waistbelt whereby such function is performed as that relative movement is provided between said setting means, tucking-in means and holder means being adapted to disengage the setting means and tuck-in means from the waistbelt and to move the waistbelt and holder means to the sewing head while maintaining a continuous grip on the waistbelt with said holder means.

BRIEF DESCRIPTION OF THE DRAWINGS

FIG. 9 is a side view of a modified form of the waistbelt end pinching apparatus showing an active plate for opening and separating or bringing the selvage gripper jaws together;

FIG. 10 is a perspective view showing the manner in which the waistbelt end is conventionally set by manual operation;

DETAILED DESCRIPTION OF THE DRAWINGS

Figure 1:
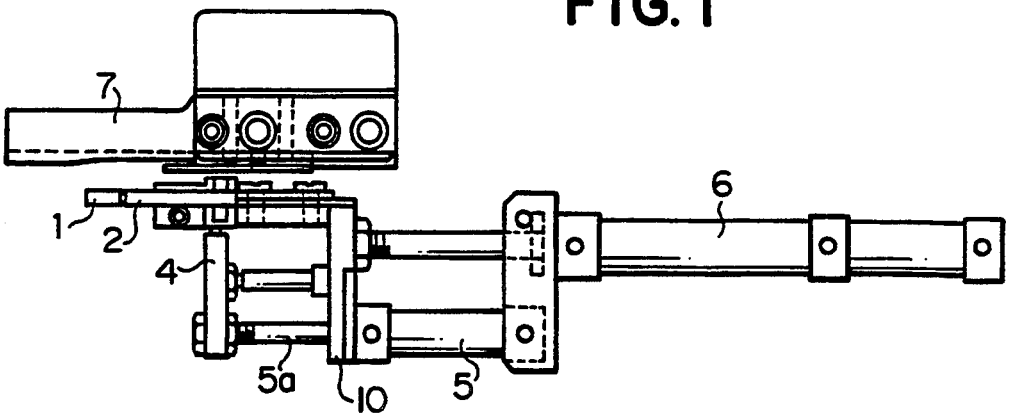
FIG. 1 is a plan view of a waistbelt end pinching apparatus according to the present invention.
Figure 2:
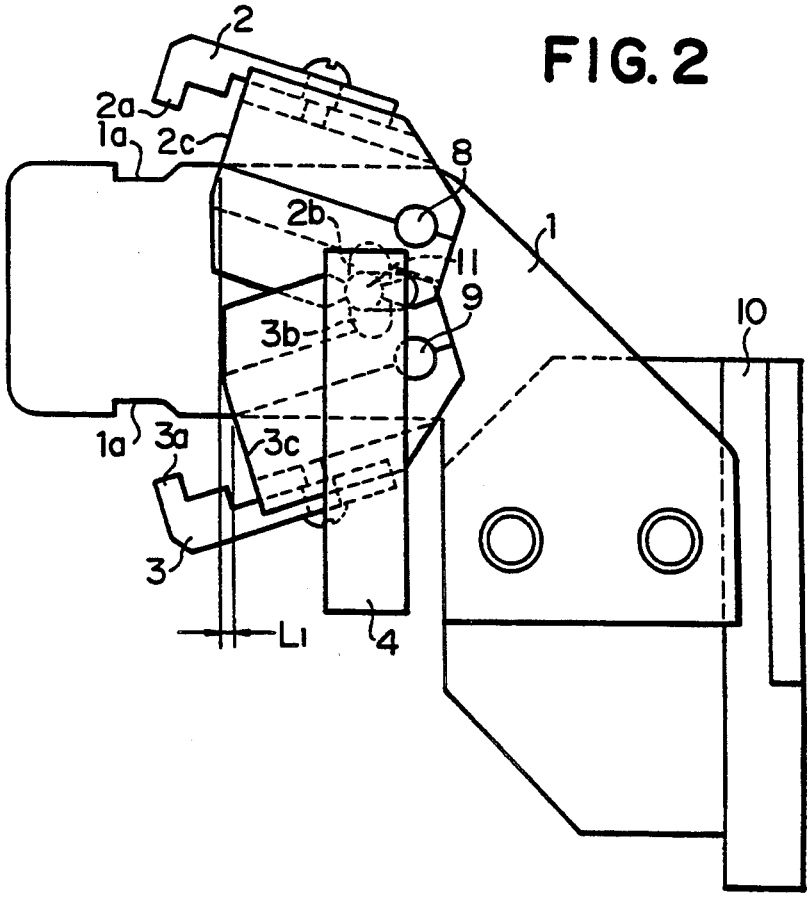
FIG. 2 is a side elevation of the waistbelt end pinching apparatus shown in FIG. 1.

A preferred embodiment of the present invention will be hereinafter described with reference to the accompanying drawings, particularly to FIG. 1 through FIG. 9, each showing a waist belt end pinching apparatus according to the present invention.

As shown, the waistbelt end pinching apparatus comprises a selvage pinching base 1 disposed ahead of the garment setting plate 7, a pair of selvage gripper jaws 2, 3 (FIG. 2) pivotally supported upwardly and downwardly of the pinching base 1, and an active plate 4 serving to open and separate or bring the jaws together, an actuator 5 such as an air cylinder or the like for operating the active plate 4, and another actuator 6 such as an air cylinder or the like for longitudinally moving the pinching base 1 by the side of a garment setting plate 7.

Figure 3:
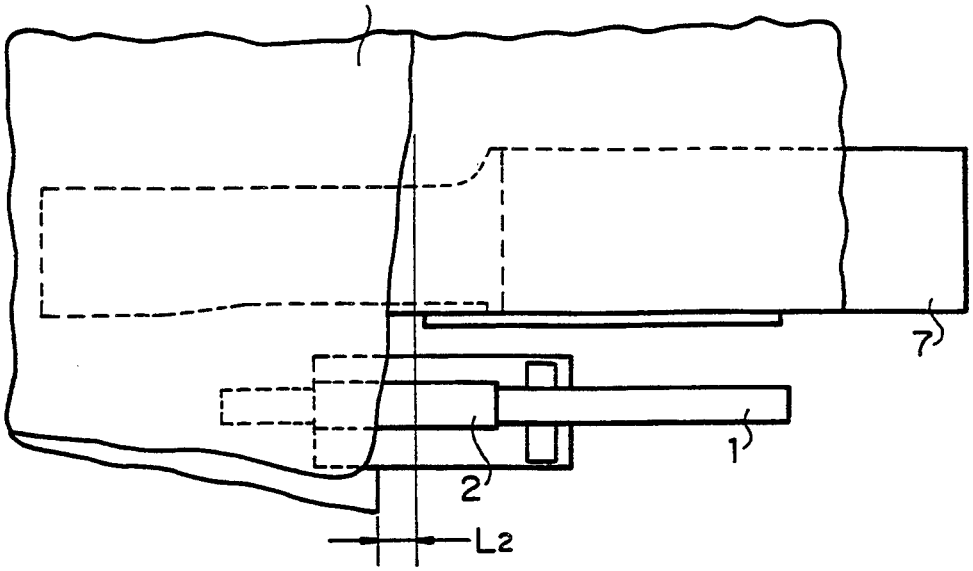
FIG. 3 is a plan view of the waistbelt end pinching apparatus which is covered with waistbelt end.

The gripper jaws 2, 3 are pivotally mounted by pivots 8, 9 on the pinching base 1. The selvage gripper jaws 2, 3 are provided at one end thereof with hooks 2*a*, 3*a* which are formed to correspond to and cooperate with recesses 1*a*, 1*a* formed in the selvage pinching base 1 at the opposite sides thereof. The gripper jaws 2, 3 are also formed with notches 2*b*, 3*b* each facing the pivots 8, 9. Edges 2*c*, 3*c* (waistbelt end receiving portion) of the selvage gripper jaws 2, 3 are positioned in such a manner that the lower gripper jaw 3 is rearwardly positioned out of alignment with the gripper jaw 2, namely, at a distance $L_1$ of about 1 mm from the gripper jaw 2 so as to obtain a finished fold at terminal edges thereof where the waistbelt end is received. In this connection, it is noted that the selvage pinching base 1 with the gripper jaws 2, 3 is located in a position (hereinafter referred to as "starting position") forwardly away from a position where the waistbelt terminal end is expected after it is set (hereinafter referred to as "set position") at a distance $L_2$ of about 5 mm, as shown in FIG. 3. This facilitates setting the waistbelt end when it is folded over the fly front of the garment.

The first actuator 5 is supported by a bracket 10 on the pinching base 1. The active plate 4 is secured to a movable portion 5*a*, viz., an air cylinder rod of the actuator 5 and is formed with a pin 11 extended from the underside thereof to engage with the notches 2*b*, 3*b*. As a result, the movable portion 5*a* of the actuator when advanced or extended, urges the front ends of the notches 2*b*, 3*b* to separate the gripper jaws from each other whereas the movable portion 5*a* is retracted to push the rear ends of the notches 2*b*, 3*b* to bring the gripper jaws together.

Although the actuator 5 for pivoting the jaws 2, 3 away from and close to each other has been described hereinbefore, another arrangement which is shown in FIG. 9 may be employed instead of the actuator 5. This arrangement is composed of links 13, 14 pivotally supported on a pivot 12 secured to the pinching base 1, and an actuator 15 such as an air cylinder or the like held by the links 13, 14 at the one ends thereof whereby the jaws 2, 3 are moved away from and close to each other. In this instance, the jaws 2, 3 may be moved to a small extent to thereby slightly bend the waistbelt terminal end as set within a short radius, thereby improving positioning accuracy.

The second actuator 6 is adapted for movement of the pinching base 1 in two steps. More specifically, in the first step, the fabric is lightly stretched to allow for extension of the pinching base 1 as a whole from the set position to the starting position by the distance $L_2$ (FIG. 3). In the second step, the cassette holder is forwardly moved to clamp the waistbelt to open the gripper jaws 2, 3 so that the pinching base 1 is retracted to a waiting position at a distance of approximately 30 mm.

Figure 4:
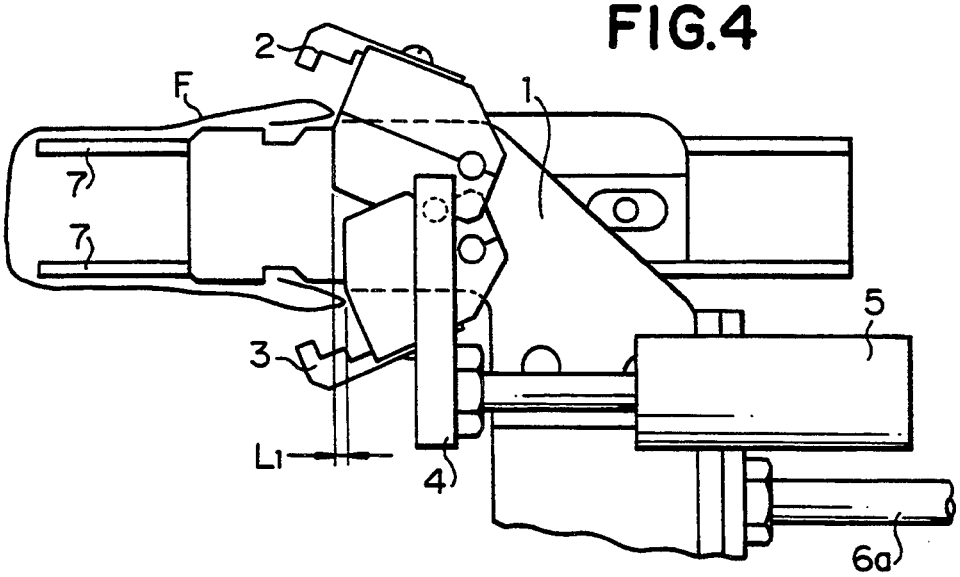
FIG. 4 is a side view of the waistbelt end pinching apparatus which is covered with waistbelt end.

For positioning and retaining the waistbelt end F over the garment setting plate 7 with the waistbelt pinching apparatus arranged as above, as shown in FIGS. 3 and 4, the garment setting plate 7 is initially covered with the waistbelt end F to insert the opposite terminal folds of waistbelt end F between the gripper jaw 2 or 3 and the pinching base 1 and then the folds are pressed deep therebetween when the gripper jaws 2, 3 are separated from each other in the starting position. At this moment, the lower fold of the waistband end is positioned longer than the upper end at the distance $L_1$.

Figure 5:
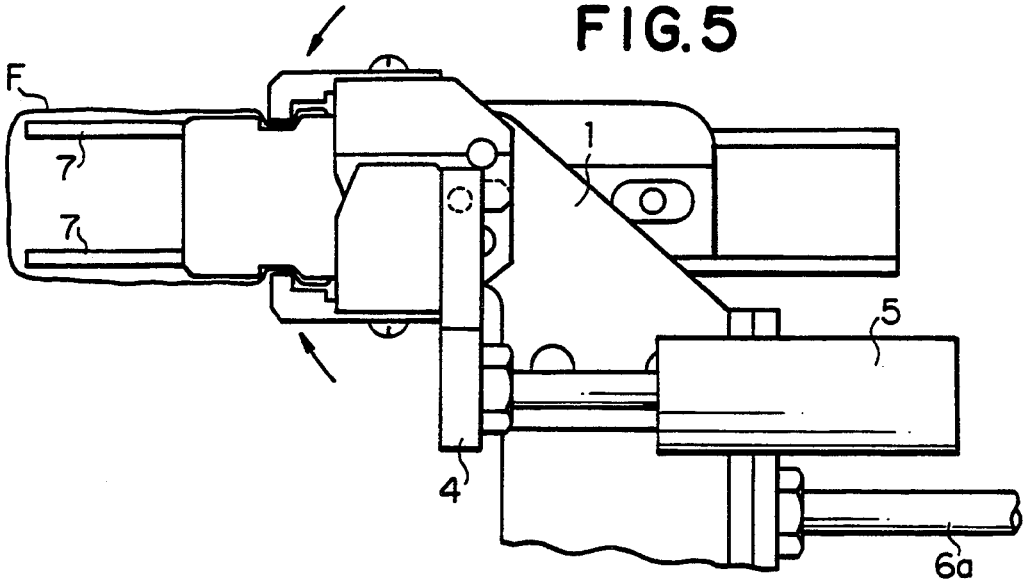
FIG. 5 is a side view of the waistbelt end pinching apparatus which is covered with the waistbelt end but showing the manner in which the waistbelt end is pinched by selvage gripper jaws.
Figure 6:
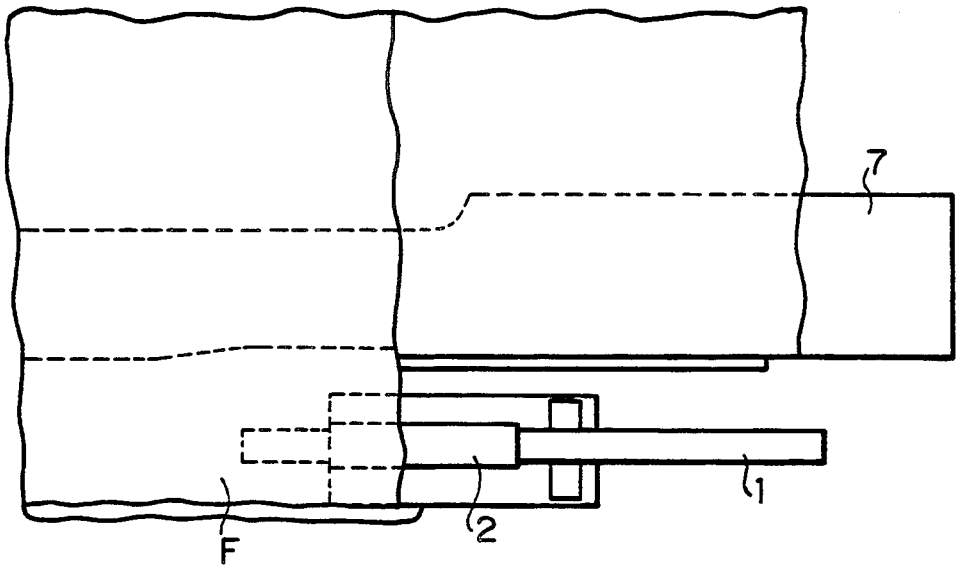
FIG. 6 is a plan view of the waistbelt end pinching apparatus which is covered with the waistbelt end but showing the manner in which the waistbelt end is withdrawn to a predetermined position by the selvage gripper jaws.
Figure 7:
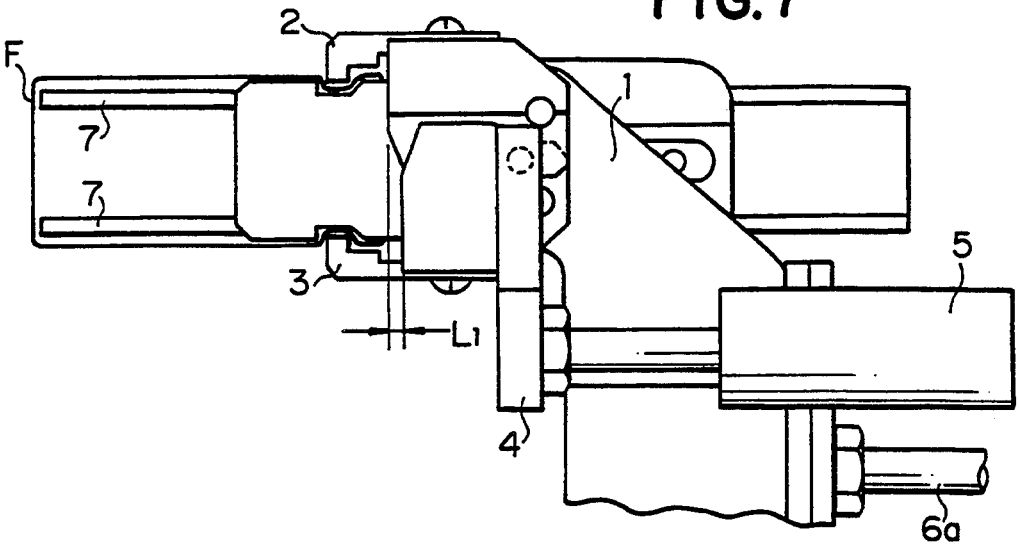
FIG. 7 is a side view of the waistbelt end pinching apparatus which is covered with the waistbelt end but showing the manner in which the waistbelt end is withdrawn to a predetermined position by the selvage gripper jaws.
Figure 8:
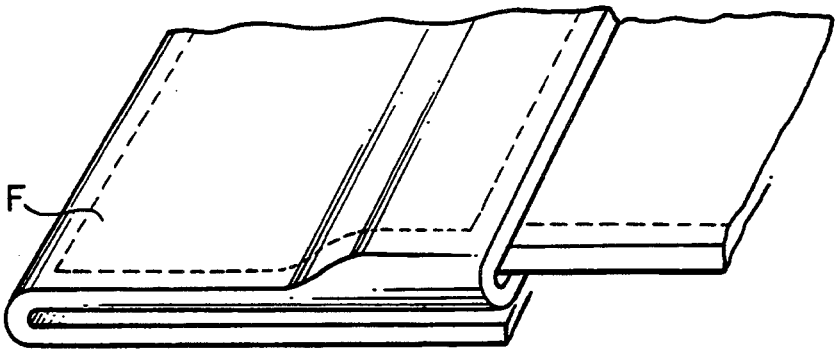
FIG. 8A is a perspective view fragmentarily showing the waistbelt end after sewed to the fly front of the garment.
FIG. 8B is a side view of the waistbelt end after sewed to the fly front of the garment.
Figure 8:
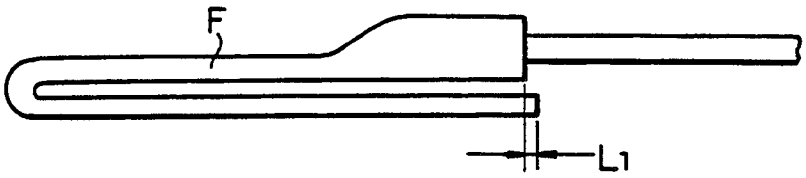

Next, as illustrated in FIG. 5, the movable portion 5*a* of the actuator 5 is retracted to bring the gripper jaws 2, 3 close to each other to hold the waistbelt end F in position. At the same time, each of the respective folds of the waistbelt end F is held between the recess as 1*a*, 1*b* and the hook 2*a* or 2*b* of the gripper jaws 2 or 3 and is bent thereby. Then, as seen from FIGS. 6 and 7, the movable portion 6*a* of the actuator 6 is retracted the distance $L_2$ to move back the pinching base 1 as well as the gripper jaws 2, 3 to the set position to withdraw the opposite folds of the waistbelt end F to maintain the fabric in a lightly stretched condition. Notwithstanding this, the waistbelt end is not removed since the upper and lower folds are maintained bended.

Thus, referring to FIG. 5, cassette holder 16 (FIG. 10) is advanced from the left side to clamp the waistbelt end F, the movable portion 6*a* of the actuator 6 retracts to separate gripper jaws 2,3 from each other and release the waistbelt end F, thereby further moving the pinching base 1 to the set position to complete setting of the waistbelt end F. Thereafter, the waistbelt end is folded, transported, and sewed according to the sequence of the operation of the conventional automatic waistbelt end folding machine.

Figure 11:
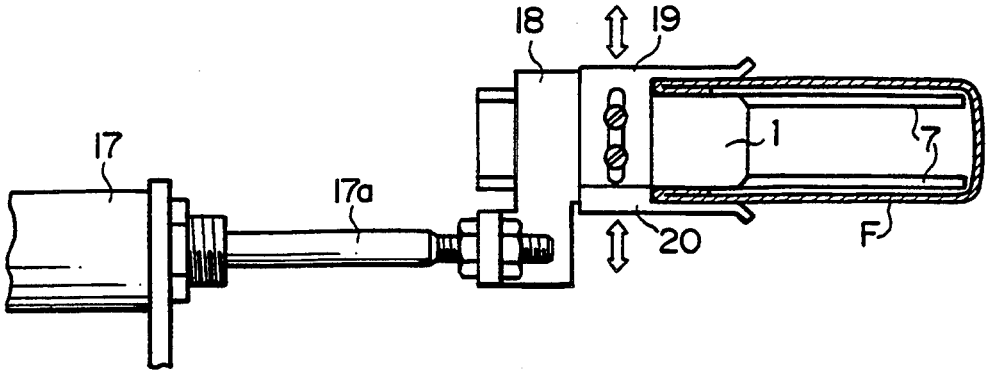
FIG. 11 is a side view of one form of the waistbelt end pinching apparatus.
Figure 12:
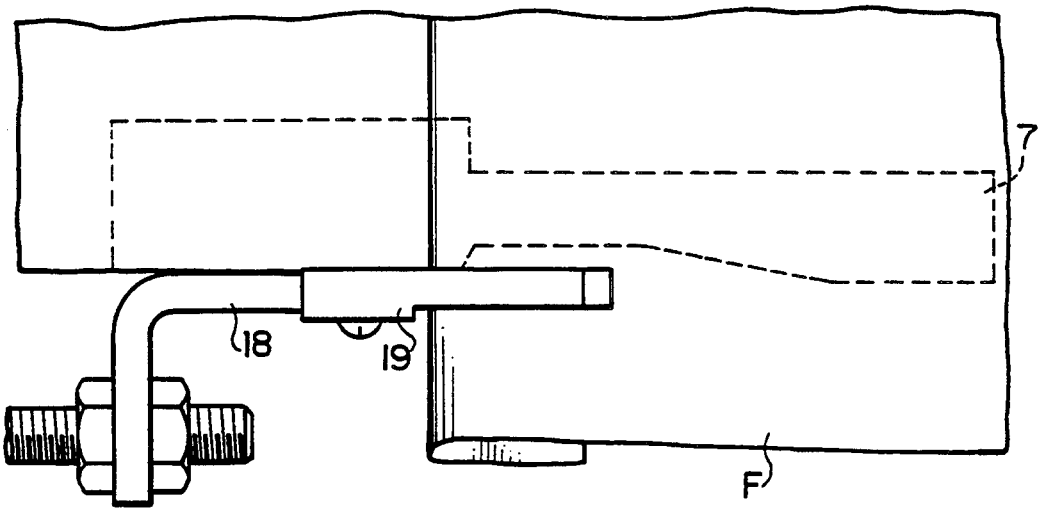
FIG. 12 is a plan view of one from of the waistbelt end pinching apparatus.
Figure 13:
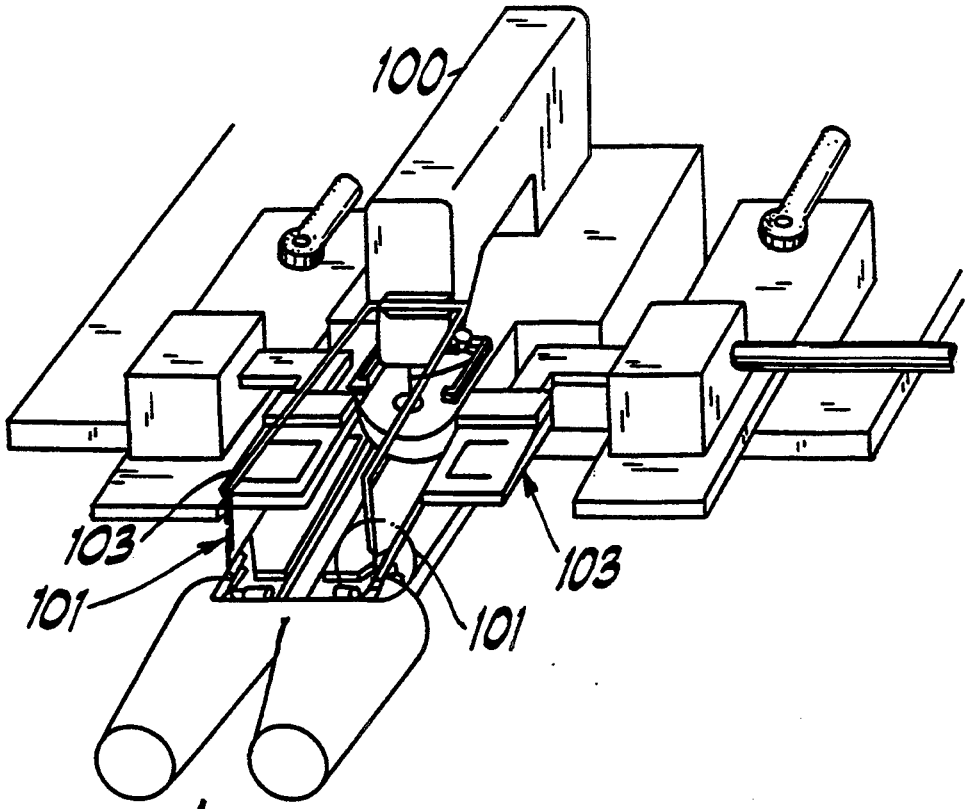
FIG. 13 PRIOR ART
FIG. 13 is a perspective view showing a conventional sewing machine for use in folding and sewing the waistbelt.
Figure 14:
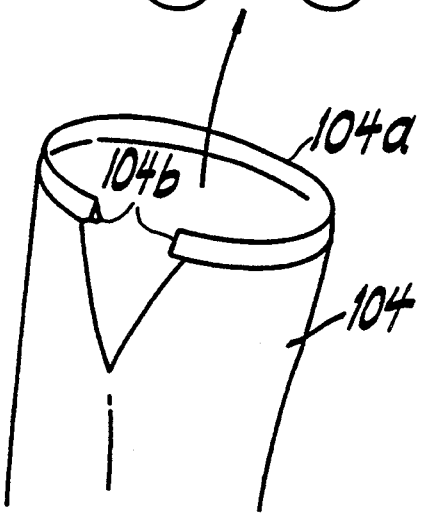
FIG. 14 PRIOR ART
FIG. 14 is a perspective view of setting means of the sewing machine shown in FIG. 13.
Figure 14:
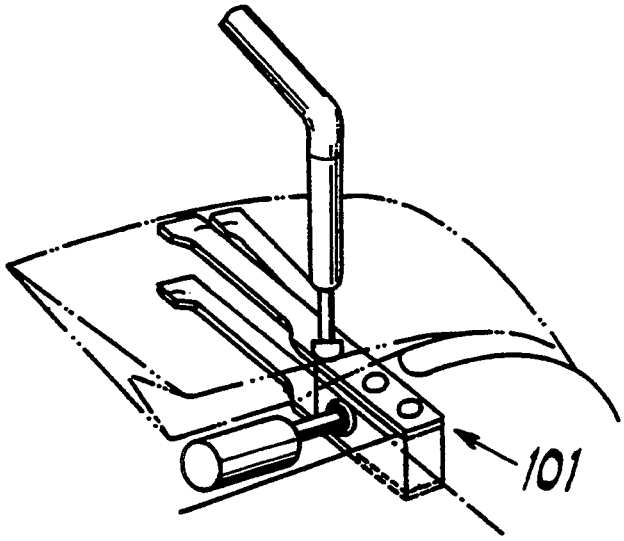
FIG. 14 PRIOR ART
Figure 15:
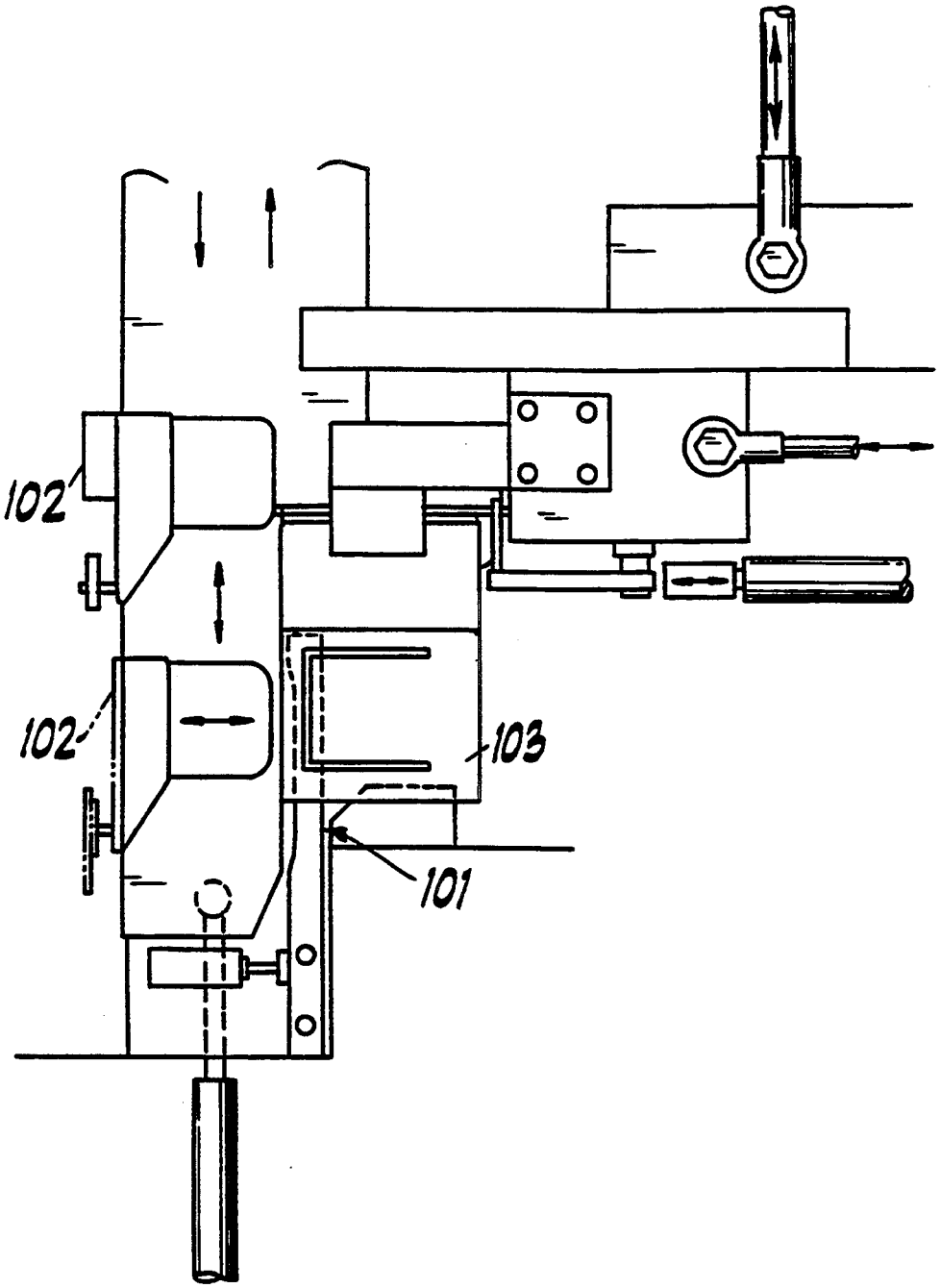
FIG. 15 PRIOR ART
FIG. 15 is a representation explanatory of the tuck-in means of the sewing machine shown in FIG. 13.

One form of the waistbelt end pinching apparatus, as best shown in FIG. 11 and 12, comprises a selvage pinching plate 18 so supported on a rod 17*a* of a cylinder 17 as to adjust its position, a selvage pinching base 1 supported thereby, and a pair of spring selvage gripper jaws 19, 20 so carried on the pinching plate 18 as to adjust a distance between the jaws. Normally, the cylinder rod 17*a* is extended from the cylinder 17 and is positioned in the proximity of a garment setting plate 7 as illustrated in FIG. 11. When the waistbelt end pinching apparatus is in the position as shown in FIG. 11, the upper and lower folds of the waistbelt end are pressed by the operator between the gripper jaws 19 or 20 and the pinching base 1 to position and hold the waistbelt end. The cassette holder is then advanced to hold the waistbelt end in position whereas the waistbelt end pinching apparatus is in turn moved toward the operator before the cassette holder is fully closed. In this manner, the waistbelt end F is removed out of the spring pincher jaws 19 and 20 and held in the cassette holder.

While the invention has been described in its preferred embodiments, it is to be understood that the words which have been used are words of description, rather than limitation, and that changes may be made within the purview of the appended claims without departing from the true scope and spirit of the invention in its broader aspects.

What is claimed is:

1. A sewing machine for sewing a waistbelt, which includes a sewing head for sewing the waistbelt of trousers after an end portion of the waistbelt has been tucked into the waistbelt, setting means insertable into the waistbelt of the trousers to position the waistbelt of the trousers prior to tucking of the end portion of the waistbelt into the waistbelt, tuck-in means insertable into the waistbelt while the waistbelt is engaged by said setting means to tuck the end portion of the waistbelt, and holder means engageable with upper and lower outer side surfaces of the waistbelt to grip the waistbelt, comprising:

waistbelt end pinching means for pinching from above and beneath said waistbelt end portion, whereby said waistbelt end portion is positioned by said setting means to allow said pinching means to grip said waistbelt end portion from both above and beneath until said waistbelt end portion is gripped by said holder means.

2. A sewing machine for sewing a waistbelt, which includes a sewing head for sewing the waistbelt of trousers after an end portion of the waistbelt has been tucked into the waistbelt, setting means insertable into the waistbelt of the trousers to position the waistbelt of the trousers prior to tucking of the end portion of the waistbelt into the waistbelt, tuck-in means insertable into the waistbelt while the waistbelt is engaged by said setting means to tuck the end portion of the waistbelt, and holder means engageable with upper and lower outer side surfaces of the waistbelt to grip the waistbelt, comprising:

waistbelt end pinching means for pinching from above and beneath said waistbelt end portion and further for positioning said side surfaces of said waistbelt end portion, whereby said waistbelt end portion is positioned by said setting means to allow said waistbelt end pinching means to grip said waistbelt end portion from both above and beneath and further position said side surfaces of said waistbelt end portion until said waistbelt end portion is gripped by said holder means.

3. A sewing machine for sewing a waistbelt as described in claim 2, wherein said waistbelt end pinching means comprises upper and lower selvage gripper jaws, having hooks formed therein, operating to be opened and closed so as to pinch said waistbelt end portion from above and beneath, said waistbelt end portion being positioned by said setting means, and a waistbelt end receiving portion for positioning said side surfaces of said waistbelt end portion by engaging said side surfaces when said upper and lower pinching member is in an open condition, and an actuator to urge said upper and lower pinching member to its open and closed positions.

4. A sewing machine for sewing a waistbelt, which includes a sewing head for sewing the waistbelt of trousers after an end portion of the waistbelt has been tucked into the waistbelt, setting means insertable into the waistbelt of the trousers to position the waistbelt of the trousers prior to tucking of the end portion of the waistbelt into the waistbelt, tuck-in means insertable into the waistbelt while the waistbelt is engaged by said setting means to tuck the end portion of the waistbelt, and holder means engageable with upper and lower outer side surfaces of the waistbelt to grip the waistbelt, comprising:

upper and lower selvage gripper jaws, having open and closed positions, engageable to pinch said waistbelt end portion from both above and beneath, said waistbelt end portion being positioned by said setting means;

a waistbelt end receiving portion against which are positioned said side surfaces of said waistbelt end portion when said upper and lower pinching plate is in an open condition; and an actuator to urge said upper and lower selvage gripper jaws to their open and closed positions.

5. A sewing machine for sewing a waistbelt as described in claim 4, wherein said side surfaces of said waistbelt end portion are disposed upwardly and downwardly, said receiving portions are separately arranged upwardly and downwardly parallel to said side surfaces, offset sideward in a direction away from said side surfaces, so as to engage said side surfaces to position said side surfaces.

6. A sewing machine for sewing a waistbelt, which includes a sewing head for sewing the waistbelt of trousers after an end portion of the waistbelt has been tucked into the waistbelt, setting means insertable into the waistbelt of the trousers to position the waistbelt of the trousers prior to tucking of the end portion of the waistbelt into the waistbelt, tuck-in means insertable into the waistbelt while the waistbelt is engaged by said setting means to tuck the end portion of the waistbelt, and holder means engageable with upper and lower outer side surfaces of the waistbelt to grip the waistbelt, comprising:

waistbelt end pinching means for pinching said waistbelt end portion from above and beneath and positioning said upper and lower side surfaces of said waistbelt end portion, whereby said waistbelt end portion is gripped and said upper and lower side surfaces are positioned by said pinching means until said waistbelt end portion is gripped by said holder means, said upper and lower side surfaces are upwardly and downwardly parallel to and offset sideward from said holder means.

7. A sewing machine for sewing a waistbelt, which includes a sewing head for sewing the waistbelt of trousers after an end portion of the waistbelt has been tucked into the waistbelt, setting means insertable into the waistbelt of the trousers to position the waistbelt of the trousers prior to tucking of the end portion of the waistbelt into the waistbelt, tuck-in means insertable into the waistbelt while the waistbelt is engaged by said setting means to tuck the end portion of the waistbelt, and holder means engageable with upper and lower outer side surfaces of the waistbelt to grip the waistbelt, comprising:

waistbelt end pinching means for pinching said waistbelt end portion, which is positioned by said setting means, from above and beneath until said waistbelt is gripped by said holder means; and displacement means for moving said pinching means a predetermined distance so as to stretch said waistbelt after said waistbelt end portion is pinched.

* * * * *